United States Patent [19]

Wright et al.

[11] 4,340,115

[45] Jul. 20, 1982

[54] WRAPPER FOR A HEAT EXCHANGE UNIT

[75] Inventors: William E. Wright, E. Syracuse; Fred V. Honnold, Jr., Fayetteville, both of N.Y.

[73] Assignee: Carrier Corporation, Syracuse, N.Y.

[21] Appl. No.: 18,204

[22] Filed: Mar. 7, 1979

[51] Int. Cl.[3] ..... F25D 17/06; F28F 11/00

[52] U.S. Cl. ..... 165/122; 165/125; 62/507

[58] Field of Search ..... 165/121, 122, 124–128; 220/80; 62/507; 98/40 V, 40 VM, 121 R

[56] References Cited

U.S. PATENT DOCUMENTS

| | | | |
|---|---|---|---|
| 636,596 | 11/1899 | Webber . | |
| 837,176 | 11/1906 | Beasley . | |
| 2,194,113 | 3/1940 | Corell et al. . | |
| 2,282,946 | 5/1942 | DeRoo | 98/101 |
| 2,346,410 | 4/1944 | Ashley et al. | 165/122 |
| 2,564,258 | 8/1951 | Herbster | 165/125 X |
| 2,565,836 | 8/1951 | Alt . | |
| 2,575,069 | 11/1951 | Rankin et al. | 220/80 |
| 2,920,464 | 1/1960 | Trask | 62/507 |
| 2,975,227 | 3/1961 | Waiter et al. . | |
| 3,223,828 | 12/1965 | Mast | 165/125 X |
| 3,245,224 | 4/1966 | Wilkinson | 165/128 |
| 4,171,937 | 10/1979 | Greenfield | 165/122 |
| 4,202,409 | 5/1980 | Cann et al. | 165/122 |

*Primary Examiner*—Samuel Scott
*Assistant Examiner*—Theophil W. Streule, Jr.
*Attorney, Agent, or Firm*—J. Raymond Curtin; Robert P. Hayter

[57] ABSTRACT

Apparatus for encasing a heat exchange unit. A wrapper is disclosed having solid portions for structural support of the heat exchange unit and fastening means including closure means formed on each end of the wrapper and a fastener strip which co-acts with said closure means to secure the wrapper in its appropriate position. Louver portions and solid portions of the wrapper are additionally disclosed to provide a structurally sound wrapper having spaced louver openings to allow air flow therethrough.

3 Claims, 6 Drawing Figures

WRAPPER FOR A HEAT EXCHANGE UNIT

BACKGROUND OF THE INVENTION

1. Field of the Invention

The present invention relates to heat exchange units which are adapted to transfer heat between a heat transfer fluid flowing through a heat exchanger and air passing thereover. More specifically, the present invention relates to a wrapper for encasing a heat exchange unit. In particular, this invention concerns means for fastening the wrapper and the location of louver openings within the wrapper such that the wrapper may provide structural support.

2. Description of the Prior Art

Heat exchange units to be mounted external of a residence or an enclosure are found in the air conditioning industry. These units typically have a heat exchanger and a fan for circulating air through the heat exchanger in heat exchange relation with refrigerant flowing through the heat exchanger. A suitable base, grille, and top cover are typically provided to encase the unit. Depending upon the application a compressor, four-way valve and controls may also be included within this outdoor unit.

When a conventional plate fin coil is utilized within an outdoor heat exchange unit the plate fin coil is often bent in a U or circular shape to provide a large surface area within a compact unit. Conventionally, a fan is mounted such that external air is drawn into the unit through the heat exchanger and exhausted out the top of the unit. These plate fin coils are structurally solid and usually serve to support the weight of the top cover to which the fan may be mounted. A grille formed from welded wire is mounted about the surface of the heat exchanger to prevent physical contact with the heat exchanger itself.

When a slit fin heat exchanger, as described below, is used instead of plate fin coils the structural integrity of plate fin coil is not maintained. Slit finned heat exchangers are formed from a long continuous tube having a U-shaped segmented fin helically wrapped thereabout to form a heat exchange surface having a myriad of heat exchange projections extending from the surface of the tube. This continuous tube may then be formed to the desired heat exchanger configuration such as a cylinder and secured within a heat exchange unit to provide for heat transfer between a heat transfer medium such as refrigerant flowing therethrough and air flowing thereover. Since there are no tube sheets nor plate fin structure connecting various tubes to each other there is no inherent structure to support the rows of slit fin tubing making up the cylindrical heat exchanger or to support the components of the unit.

The wrapper disclosed herein is designed to encase a slit fin coil and to have solid portions which may provide structural support for the unit. Additionally, the wrapper has closure means which cooperate with a fastening strip to secure the wrapper in position. Furthermore, the use of a wrapper having louvered portions as disclosed herein may obviate the necessity of painting the coil since utilizing these louver openings instead of the previous welded wire grille results in the heat exchanger being substantially hidden from view. Consequently it is the exterior surface of the wrapper rather than the heat exchanger which becomes esthetically important.

SUMMARY OF THE INVENTION

An object of the present invention is to provide a wrapper for encasing a heat exchange unit.

A more specific object of the present invention is to have a wrapper for heat exchange units which provides structural support to the unit as well as having louver openings for the passage of air therethrough.

A more specific object of the present invention is to secure the abutting ends of the wrapper utilizing a fastening strip.

A yet further object of the present invention is to provide an esthetically pleasing wrapper for use with an outdoor heat exchange unit.

A further object of the present invention is to provide a safe, reliable, inexpensive, and esthetically pleasing wrapper which is easy to manufacture and assemble.

Other objects will be apparent from the description to follow and from the appended claims.

The preceding objects are achieved according to a preferred embodiment of the invention by providing a sheet of material to act as a wrapper or protector for use in a heat exchange unit having a heat exchanger, a base, a top and a fan for circulating air therethrough. This sheet of material has openings therein to allow air flow therethrough and additionally has closure means mounted on each end of the sheet which cooperate with a fastening strip to secure the sheet of material in the appropriate position. Additionally, the wrapper has structural and louvered portions arranged to provide structural support as well as air entry openings therethrough.

DESCRIPTION OF THE PREFERRED EMBODIMENT

The embodiment of the invention described below is adapted for use in a heat exchange unit which may be mounted exterior of a residence or other enclosure to be supplied with conditioned air. This heat exchange unit typically has a heat exchanger having refrigerant or the heat transfer medium flowing therethrough and air passing thereover. This heat exchange unit is usually supported on the bottom by a base and has located at the top thereof a fan for circulating air therethrough. Air is typically circulated inward through the sides of the unit and discharged outward through the top of the unit. The top of the unit may define louver openings for this discharge of air. The outdoor unit described may be mounted on the ground, to a wall, on a roof, or similar location where outdoor air may be circulated therethrough without impediment. Additionally, these units may act as the condenser in a refrigeration circuit, or as an outdoor coil in the heat pump such that it may operate either as an evaporator or a condenser. Furthermore, the unit may include such additional components as a compressor, four-way valve, controls, accumulator, filter-dryer, and other components normally formed with an air conditioning system employing a mechanical refrigeration unit.

Figure 1:
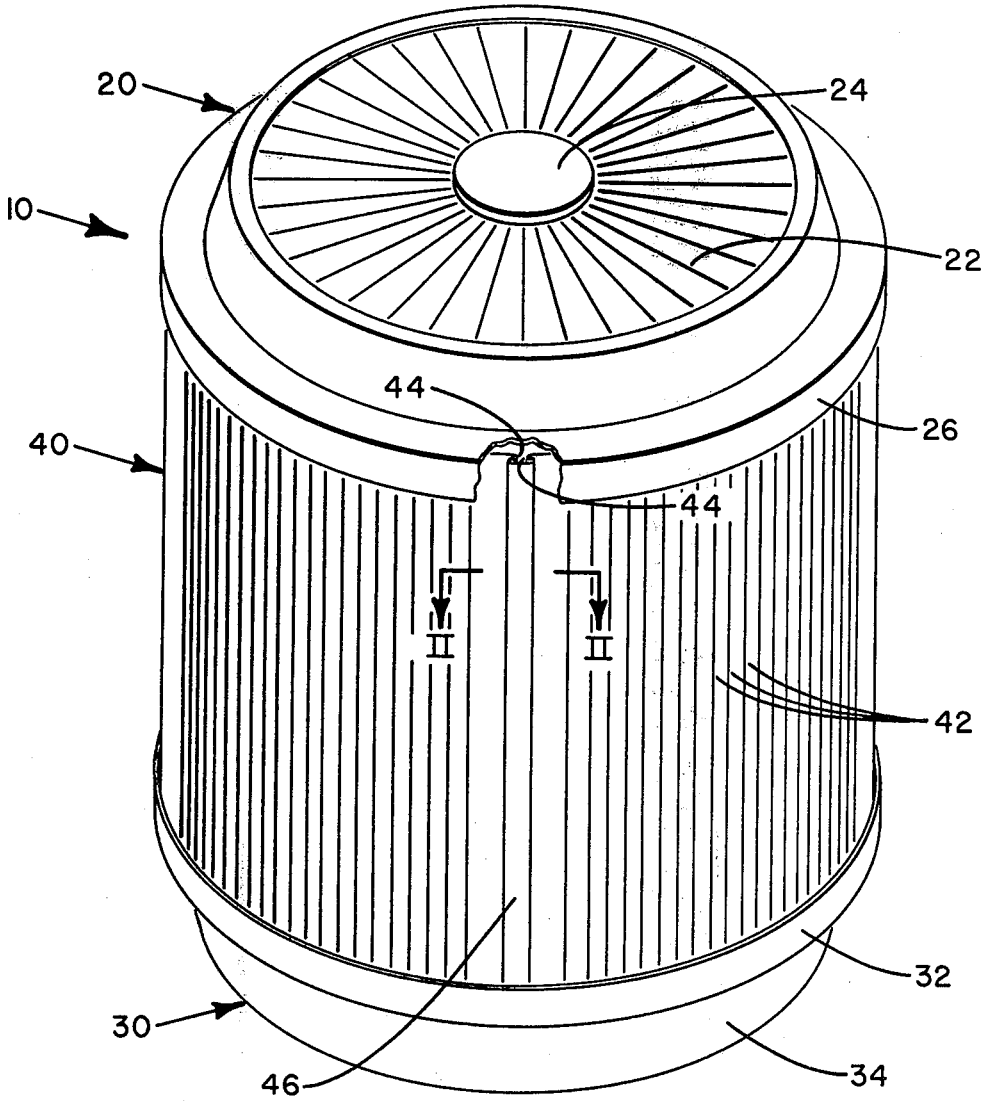
FIG. 1 is a perspective view of the heat exchange unit having the wrapper and wrapper fastening system as described herein.

Referring now to the drawings, FIG. 1 shows in perspective a conventional cylindrical outdoor heat exchange unit. This unit designated by reference 10 includes a base 30, a top cover 20 and wrapper 40. Base 30 is of a cylindrical configuration and has a bottom portion 34 which may rest on a concrete pad to support the unit and a cylindrical portion 32 which is adapted to have the wrapper inserted therein.

Top cover 20 is generally cylindrical in shape and has a center portion 24 from which a fan motor may be mounted, louver segments 22 through which air may be circulated by a fan (not shown) mounted from the center portion of the top cover or elsewhere within the unit, and cylindrical portion or flange 26 sized to fit outside of the wrapper to secure the wrapper.

Wrapper 40 is a flat sheet of material formed with the appropriate louvers 42 such that air may flow therethrough to the unit. Wrapper 40 is mounted within cylindrical portion 26 of top cover 20 and cylindrical portion 32 of face 30 such that it is limited in outward movement by both. It can be seen in FIG. 1 that wrapper 40 has vertically extending segments which provide structural support between the base and top cover of the unit. A portion of top cover 20 is cut-away in FIG. 1 to show the end portions 44 of wrapper 40 and their co-action with fastener strip 46.

Figure 6:
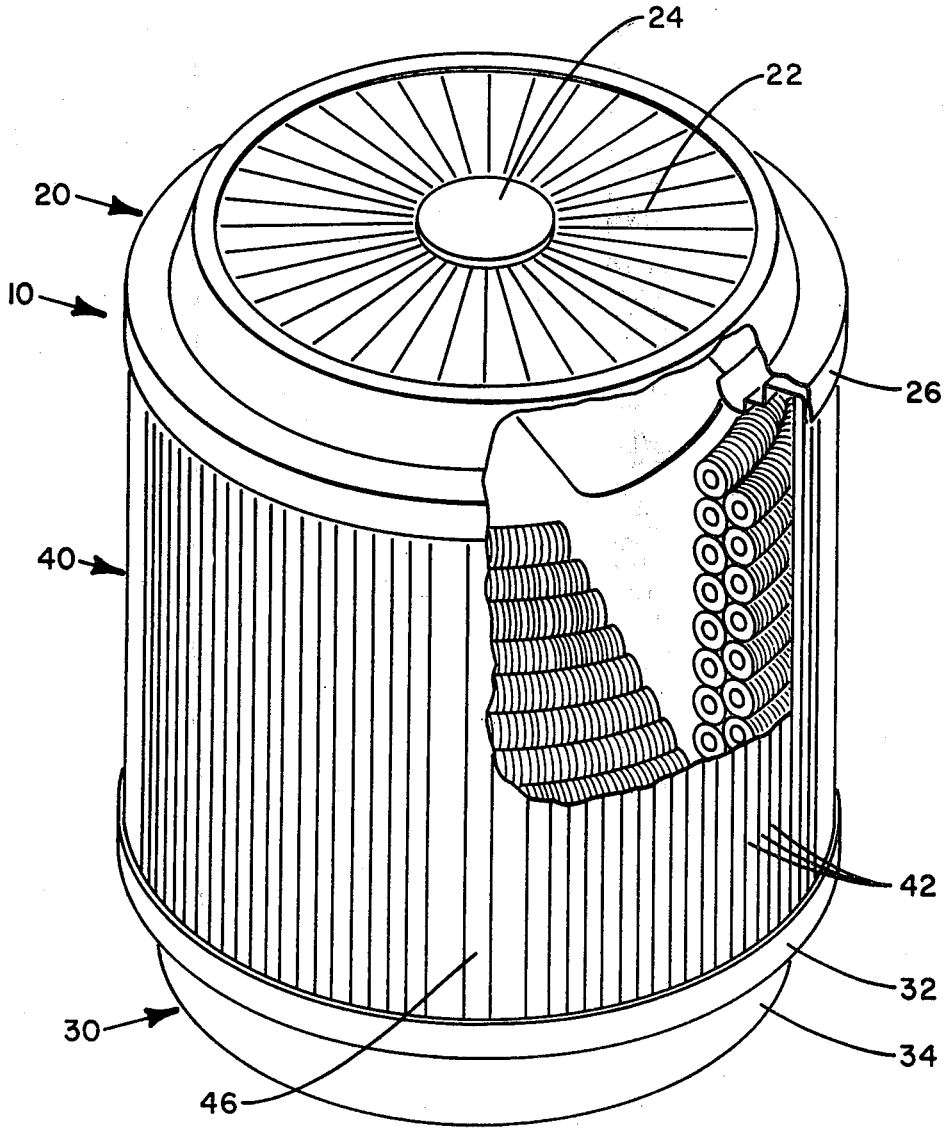
FIG. 6 is a perspective view of the heat exchange unit as shown in FIG. 1 having a portion of the wrapper cut away to show the slit fin heat exchanger and an edge of the fan blade.

As can be seen in FIG. 6, the cutaway view of FIG. 1, the slit fin heat exchanger extends about the interior of the unit in a generally cylindrical configuration. The edge of the fan blade is observable, said fan blade acting to draw ambient air through wrapper 40, through the slit fin heat exchanger and then discharging the air out the top of the unit through top cover 20.

Figure 2:
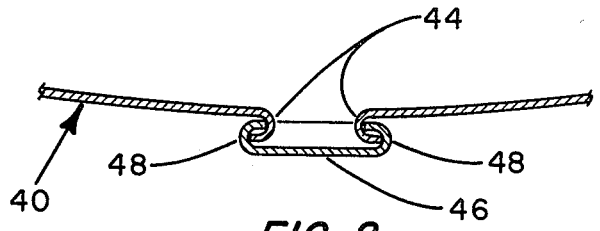
FIG. 2 is a cross-sectional view of the wrapper and fastener strip taken along line II—II in FIG. 1.

The interaction of the wrapper and the fastener strip can be better seen in FIG. 2 which is a cross-sectional view taken at line II—II of FIG. 1. Therein it can be seen that wrapper 40 has its opposite edges bent backwards to form a U-shaped end portion 44 mounted on each end thereof. These U-shaped portions extend outwardly from the wrapper and are adapted to be engaged by fastener strip 46. Fastener strip 46 likewise has two U-shaped end portions 48 which engage the U-shaped portions 44 of wrapper 40. This fastener strip is adapted to be slidably engaged to the end portions of the wrapper to fixedly secure same in position. This fastener strip is engaged to the wrapper prior to the top cover being assembled to the unit. Once the fastener strip is engaged the ends of the wrapper are secured in position providing a solid structural support which encases the entire unit. The U-shaped ends of the wrapper could also be bent inwardly such that the fastener strip engages the ends on the interior side of the wrapper. A decorative portion could then be attached to the strip through a space between the ends of the wrapper to provide an esthetically pleasing decorative strip over the joint area.

Figure 3:
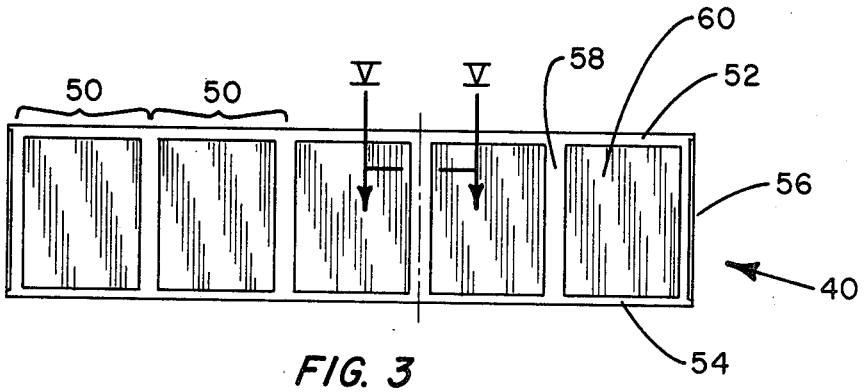
FIG. 3 is a view illustrating a flat sheet metal strip having portions removed preparatory to folding the strip into the wrapper configuration.
Figure 4:
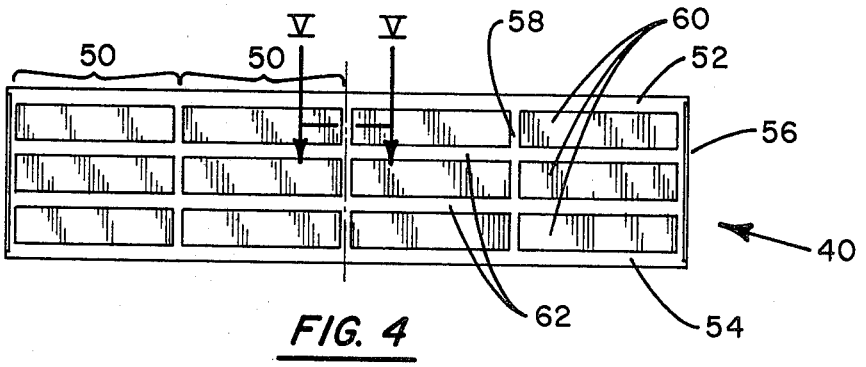
FIG. 4 is a view of another embodiment of a flat sheet prior to being folded into the wrapper configuration.
Figure 5:
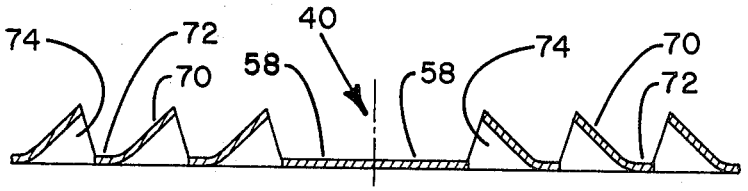
FIG. 5 is a cross-sectional view taken along line V—V in FIG. 3.

Referring now to FIGS. 3 and 4 it can be seen that the wrapper is formed from a sheet of flat material. This sheet is divided into various areas designated as 50 each area having solid portions and louvered portions. In each area 50, as can be seen in FIG. 3, there is a top solid portion 52 and bottom solid portion 54 extending the width of the wrapper and additionally a side solid portion 56 and side solid portion 58 extending vertically between the top and bottom solid portions of the wrapper. The top and bottom portions together with the two side solid portions act to form a structural support. Mounted between these various solid portions is louver portion 60. As can be better seen in FIG. 5 the louver portion has deformed louver extensions which are separated from the plane of the sheet to create an opening designated as louver opening 74 therebetween. The louver extensions 70 are connected to louver segments 72 which secure them to the wrapper. A series of louver extensions and louver segments are provided in each louver portion such that a group of spaced openings for air flow therebetween are provided. Each louver extension is deflected outwardly sufficiently to provide air flow but without being deflected so far that a visual inspection would present a substantial view of the heat exchanger underneath. In other words, looking directly at the unit the bulk of the heat exchanger beneath the louver portions would be hidden.

FIG. 4 is another embodiment of the wrapper wherein within each area 50 the louver portion is divided into several portions 60 having horizontal solid portions therebetween. These horizontal solid portions further act to increase the structural integrity of the unit.

Additionally the vertical side solid portions 58 between adjacent areas 50 are connected. Depending upon the location in the wrapper the direction of deflection of the louvers may be altered. It has been found for esthetic purposes that the direction of deflection may be reversed at some point in the unit to create a symmetrical effect. This reversal may occur at the center of the wrapper as well as the ends such that each half of the wrapper is deflected in the same direction. Additionally, deflection may all be downwardly such that it makes no difference whether it is deflected towards one side or the other. Also the wrapper may be formed of two portions, each covering one half of the unit and each louvers angled in but one direction. Of course, if two portions are used it will be necessary to have two joints.

A wrapper suitable for use in outdoor heat exchange units has been described herein. This wrapper has a specific fastening method which is used to secure the ends thereof. Additionally, structural support is provided therein such that when used with a slit fin heat exchange unit the wrapper itself may provide structural integrity to the unit. The invention has been described in detail with particular reference to a preferred embodiment thereof but it will be understood that variations and modifications can be affected within the spirit and the scope of the invention.

What is claimed is:

1. A cylindrical heat exchange unit for use with a refrigeration circuit having refrigerant flowing therethrough which comprises:

a base pan for supporting the unit;

a slit fin heat exchanger secured in a cylindrical configuration and supported by the base pan, said heat exchanger serving to transfer heat energy between refrigerant flowing through the heat exchanger and air flowing over the heat exchanger;

a wrapper supported by the base pan for encasing the slit fin heat exchanger, said wrapper including vertically extending louver openings formed into groupings spaced about the entire circumference of the unit with solid vertical portions located between the groupings for providing structural support between other portions of the heat exchange unit, said louver openings being formed to face opposite directions on opposing sides of the unit to enable the slit fin heat exchanger to be hidden from view while allowing air flow thereto, said wrapper additionally having closure means located at the ends thereof;

means for securing the ends of the wrapper to maintain the wrapper in position;

a top cover for encasing the top portion of the unit, said top cover being supported by the wrapper about the circumference of the unit and including air discharge openings; and fan means for drawing air into the heat exchange unit through the louver openings in the wrapper, then through the slit fin heat exchanger and discharging said air from the unit through the top cover.

2. The apparatus as set forth in claim 1 wherein the wrapper defines solid horizontal portions extending between adjacent vertical portions such that each louver opening grouping is divided into a plurality of subgroupings.

3. The apparatus as set forth in claim 1 wherein the closure means located at each end of the wrapper is an end portion of the wrapper formed into a U-shaped portion and wherein the means for securing the ends of the wrapper is a fastening strip having two U-shaped ends connected by a body portion, one end to engage each end of the wrapper.

* * * * *